US011332990B2

(12) United States Patent
Strilchuk

(10) Patent No.: US 11,332,990 B2
(45) Date of Patent: May 17, 2022

(54) CATCHER DEVICE FOR A DOWNHOLE TOOL

(71) Applicant: SCHOELLER-BLECKMANN OILFIELD EQUIPMENT AG, Ternitz (AT)

(72) Inventor: Nathan Strilchuk, Beaver County (CA)

(73) Assignee: Schoeller-Bleckmann Oilfield Equipment AG, Ternitz (AT)

( * ) Notice: Subject to any disclaimer, the term of this patent is extended or adjusted under 35 U.S.C. 154(b) by 30 days.

(21) Appl. No.: 16/955,710

(22) PCT Filed: Dec. 19, 2018

(86) PCT No.: PCT/EP2018/085975
§ 371 (c)(1),
(2) Date: Jun. 18, 2020

(87) PCT Pub. No.: WO2019/122004
PCT Pub. Date: Jun. 27, 2019

(65) Prior Publication Data

US 2021/0071491 A1 Mar. 11, 2021

(30) Foreign Application Priority Data

Dec. 20, 2017 (GB) ..... 1721482

(51) Int. Cl.
*E21B 41/00* (2006.01)
*E21B 34/14* (2006.01)
(Continued)

(52) U.S. Cl.
CPC ..... *E21B 27/00* (2013.01); *E21B 17/05* (2013.01); *E21B 34/142* (2020.05); *E21B 2200/06* (2020.05)

(58) Field of Classification Search
CPC ..... E21B 34/14; E21B 41/00; E21B 23/0413
See application file for complete search history.

(56) References Cited

U.S. PATENT DOCUMENTS 4,889,199 A 12/1989 Lee
5,499,687 A 3/1996 Lee
(Continued)

FOREIGN PATENT DOCUMENTS

CN 102791955 A 11/2012
CN 107466336 A 12/2017
(Continued)

OTHER PUBLICATIONS

Search Report issued in corresponding Russian Application No. 2020120284, dated Feb. 26, 2021,. 10 pages.
(Continued)

*Primary Examiner* — Kipp C Wallace
(74) *Attorney, Agent, or Firm* — Lewis Roca Rothgerber Christie LLP

(57) ABSTRACT

A downhole catcher device comprises a catching mechanism which is configured to be transferable between a first mode and a second mode. The catching mechanism is further configured for passing by a first operation element if the catching mechanism is in the first mode and for catching a second operation element if the catching mechanism is in the second mode. The transfer between the first and the second mode is triggered (or effected) by a downhole tool which is operated by the second operation element.

19 Claims, 9 Drawing Sheets

(51) Int. Cl.
*E21B 27/00* (2006.01)
*E21B 17/05* (2006.01)

(56) References Cited

U.S. PATENT DOCUMENTS

| | | | | |
|---|---|---|---|---|
| 6,003,607 | A | 12/1999 | Hagen et al. | |
| 6,216,785 | B1 | 4/2001 | Achee, Jr. et al. | |
| 6,220,360 | B1 * | 4/2001 | Connell | E21B 23/00 166/373 |
| 7,530,400 | B2 | 5/2009 | Telfer | |
| 8,118,101 | B2 | 2/2012 | Nelson et al. | |
| 2006/0054354 | A1 | 3/2006 | Orban | |
| 2006/0113115 | A1 | 6/2006 | Lee | |
| 2007/0107944 | A1 | 5/2007 | Lee | |
| 2007/0240883 | A1 | 10/2007 | Telfer | |
| 2007/0272412 | A1 * | 11/2007 | Telfer | E21B 23/00 166/318 |
| 2007/0272413 | A1 | 11/2007 | Rytlewski et al. | |
| 2009/0308588 | A1 | 12/2009 | Howell et al. | |
| 2011/0024106 | A1 * | 2/2011 | Nelson | E21B 23/04 166/117 |
| 2011/0315389 | A1 | 12/2011 | Crider et al. | |
| 2012/0055714 | A1 * | 3/2012 | Adam | E21B 41/00 175/57 |
| 2012/0073827 | A1 | 3/2012 | Kenyon et al. | |
| 2012/0085548 | A1 * | 4/2012 | Fleckenstein | E21B 43/14 166/373 |
| 2013/0118732 | A1 | 5/2013 | Chauffe et al. | |
| 2014/0138101 | A1 | 5/2014 | Arabsky et al. | |
| 2014/0216761 | A1 | 8/2014 | Trinh et al. | |
| 2014/0299319 | A1 * | 10/2014 | Pabon | E21B 41/00 166/285 |
| 2014/0318815 | A1 | 10/2014 | Merron | |
| 2015/0027725 | A1 * | 1/2015 | Adam | E21B 34/14 166/373 |
| 2015/0308229 | A1 * | 10/2015 | Patton | E21B 34/12 166/386 |
| 2017/0089166 | A1 * | 3/2017 | Sullivan | E21B 23/08 |
| 2018/0112494 | A1 * | 4/2018 | Hered | E21B 21/103 |
| 2020/0149363 | A1 * | 5/2020 | Cho | E21B 23/006 |

FOREIGN PATENT DOCUMENTS

| | | | |
|---|---|---|---|
| EA | 009636 | B1 | 2/2008 |
| GB | 2 416 555 | B | 12/2006 |
| GB | 2 427 634 | B | 5/2007 |
| GB | 2 435 656 | A | 9/2007 |
| RU | 2331753 | C2 | 8/2008 |
| SU | 594296 | A1 | 2/1978 |
| WO | WO 02/14650 | A1 | 2/2002 |
| WO | 2004/088091 | A1 | 10/2004 |
| WO | WO 2006/134446 | A2 | 12/2006 |
| WO | 2008146012 | A2 | 12/2008 |
| WO | WO 2011/061239 | A2 | 5/2011 |
| WO | WO 2013/092532 | A1 | 6/2013 |
| WO | WO 2013/169993 | A1 | 11/2013 |
| WO | WO 2018/050418 | A1 | 3/2018 |

OTHER PUBLICATIONS

Brochure: "Well Commander—Mitigate drilling hazards with the industry's most versatile drilling valve", Mi SWACO, 2009, SBR. 1961.0912.R1 (E) Litho in U.K., www.miswaco.com, 6 pages.
Schlumberger, "Well Commander", Mi SWACO, Jul. 13, 2017, https://web.archive.org/web/20170713234843/http://www.slb.com/serv . . . , 3 pages.
"Conduct mid-string circulation during drilling and wellbore cleanup", XP Circulation Valve; Baker Hughes, https://web.archive.org/web/20170509163804/https://www.bakerhughe . . . , 1 page.
Well Commander, "Ball-activated drilling circulating valve", Mi SWACO, A Schlumberger Cmpany, 1 page.
Well Commander, Specialized Tools, Wellbore Productivity, Mi SWACO, 2009, SPB.1961.0911.R1 (E), www.miswaco.com, 3 pages.
Overview "XP Multi-Cycle Ball-Activated Circulation Valve", Baker Hughes, 2012, www.bakerhughes.com, 2 pages.
International Search Report and Written Opinion of corresponding PCT/EP2018/085975, dated Jun. 25, 2019, 20 pages.
Invitation to Correct and Partial Search of corresponding PCT/EP2018/085975, dated Apr. 12, 2019, 14 pages.
Chinese Office action for Patent Application No. 201880080663.5, dated Sep. 3, 2021, 15 pages.

* cited by examiner

CATCHER DEVICE FOR A DOWNHOLE TOOL

CROSS-REFERENCE TO RELATED APPLICATIONS

This application is a National Phase Patent Application and claims priority to and the benefit of International Application Number PCT/EP2018/085975, filed on 19 Dec. 2018, which claims priority to and the benefit of Great Britain Patent Application No. 1721482.6 (GB), filed 20 Dec. 2017, the entire contents of all of which are incorporated herein by reference.

FIELD OF INVENTION

The present invention relates to the field of catcher devices for a downhole tool.

BACKGROUND

US 2011/0024106 A1 discloses a ball catcher is designed to stop balls that are the same size or different sizes at an inlet on a seat that is connected to a movable biased sleeve. Once the ball or other shaped object lands at the seat the flow around it increases differential pressure on the seat and sleeve and displaces them against the bias. The ball goes into a surrounding annular space and cannot exit. A preferably spiral sleeve guide the movement of the balls in the annular space so that efficient use of the annular space is made to maximize the number of balls that can be captured per unit length of the annular space. As soon as the ball enters the annular space the sleeve shifts back to the original position to stop the next ball at the inlet. Once in the annular space, the balls cannot escape if there is a flow reversal. The central passage remains open to pass other tools and flow.

US 2007/0272412 A1 discloses a ball catcher for selectively catching and retaining drop balls in a well bore. The catcher is located on a workstring. A main bore axially through the catcher is restrained to provide first and second bores of differing diameters. The first bore is further restricted at a lower end, thus balls within the first bore are retained and balls in the second bore pass through the catcher. The bores preferably overlap to provide a channel so that smaller balls can pass between the bores for release. In one embodiment, the second bore is located centrally through the catcher so that wireline tools and the like can be run through the catcher.

SUMMARY

In view of the above-described situation, there still exists a need for an improved technique for catcher device capable of catching an operation element and being capable of allowing operation of a tool that is located downstream the catcher device.

This need may be met by the subject matter according to the independent claims. Advantageous embodiments of the herein disclosed subject matter are described by the dependent claims.

According to a first aspect of the herein disclosed subject matter a downhole catcher device (also referred to as catcher device) is provided. According to an embodiment of the first aspect there is provided a downhole catcher device, the catcher device comprising: a catching mechanism being transferable between a first mode and a second mode; the catching mechanism being configured for passing by a first operation element if the catching mechanism is in the first mode; the catching mechanism being configured for catching a second operation element if the catching mechanism is in the second mode.

According to a second aspect of the herein disclosed subject matter a downhole tool is provided. According to an embodiment of the second aspect, there is provided a downhole tool comprising a hollow tool body and a coupling element movable within the hollow tool body and being coupleable to a coupling element of a catching mechanism of a catcher device to which the hollow tool body is mountable.

According to an embodiment of a third aspect of the herein disclosed subject matter a tool and catcher combination is provided. According to an embodiment of the third aspect, there is provided a tool and catcher combination comprising the catcher device according to the first aspect or an embodiment thereof and a downhole tool according to the second aspect or an embodiment thereof.

According to an embodiment of a fourth aspect of the herein disclosed subject matter a method of operating a downhole catcher device is provided. According to an embodiment of the fourth aspect, there is provided a method of operating a downhole catcher device comprising a catching mechanism, the method comprising: transferring the catching mechanism between a first mode for passing by a first operation element and a second mode for catching a second operation element.

DESCRIPTION OF EXEMPLARY EMBODIMENTS

In the following, exemplary embodiments of the herein disclosed subject matter are described, any number and any combination of which may be realized in an implementation of aspects of the herein disclosed subject matter.

According to embodiments of the first aspect, the catcher device is adapted for providing the functionality and/or features of one or more of the herein disclosed embodiments and/or for providing the functionality and/or features as required by one or more of the herein disclosed embodiments, in particular of embodiments of any one of the aspects disclosed herein.

According to embodiments of the second aspect, the downhole tool is adapted for providing the functionality and/or features of one or more of the herein disclosed embodiments and/or for providing the functionality and/or features as required by one or more of the herein disclosed embodiments, in particular embodiments of any one of the aspects disclosed herein.

According to embodiments of the third aspect, the tool and catcher combination is adapted for providing the functionality and/or features of one or more of the herein disclosed embodiments and/or for providing the functionality and/or features as required by one or more of the herein disclosed embodiments, in particular embodiments of any one of the aspects disclosed herein.

According to embodiments of the fourth aspect, the method is adapted for providing the functionality and/or features of one or more of the herein disclosed embodiments and/or for providing the functionality and/or features as required by one or more of the herein disclosed embodiments, in particular embodiments of any one of the aspects disclosed herein.

Generally herein, the term "coupled" means coupled so as to transfer forces and includes in particular at least one of axially coupled and rotationally coupled. Generally herein, the term "axially coupled" means coupled so as to transfer axial forces. Further, generally herein the term "rotationally coupled" means coupled so as to transfer torque. Further, the term "coupled" includes directly coupled and indirectly coupled (i.e. coupled over an intermediate element). Further, special the specification of a particular coupling (e.g. axially coupled or rotationally coupled) generally does not exclude further coupling. For example, the specification that two elements are axially coupled does not exclude (but also does not necessarily require) that these elements are also rotationally coupled.

According to an embodiment, the catcher device comprises a hollow body. According to a further embodiment, the hollow body is configured to be mountable into a string or tube, e.g. a drillstring. According to a further embodiment, the catching mechanism is located within the hollow body.

According to an embodiment, the second operation element is an operation element of a downhole tool that is located upstream the catching mechanism.

According to a further embodiment, the catching mechanism is operated by the downhole tool. For example, according to an embodiment, the catcher device comprises a coupling element (also referred to as first coupling element) for coupling the catching mechanism to a coupling element of the downhole tool (also referred to as second coupling element). According to an embodiment, the downhole tool is located upstream the catching mechanism. According to a further embodiment, a movement of the first coupling element in a first direction transfers the catching mechanism from the first mode to the second mode. According to a further embodiment, a movement of the first coupling element in a second direction transfers the catching mechanism from the second mode into the first mode. For example, according to an embodiment the movement of the first coupling element in the second direction is a return movement, i.e. a movement in a direction opposite the first direction.

According to a further embodiment, the first coupling element forms at least part of a swivel coupling. However, any other suitable type of coupling can be employed. For example, according to an embodiment the swivel coupling comprises rolling bearing elements which are provided between the first coupling element and the second coupling element. According to a further embodiment, the first coupling element comprises a first groove; and the second coupling element comprises a second groove, the second groove facing the first groove (in a coupled state); and the rolling bearing elements are running in both the first groove and the second groove to thereby allow a rotation of the first coupling element with respect to the second coupling element and to limit an axial movement of the first coupling element and the second coupling element with respect to each other (thereby allowing to transfer forces and movements in axial direction via the first and second coupling element). According to an embodiment, the axial movement is a movement in the axial direction (typically a direction along the string into which the catcher device is mounted). According to an embodiment, the hollow body is a tubular body having a largest extent in the axial direction. According to an embodiment at least one of the first groove and the second groove comprises a transverse (e.g. radial) through hole through which the rolling bearing elements are insertable into the space defined by (defined between) the opposing first and second groove. In accordance with an embodiment, by the insertion of the rolling bearing elements into the space defined by the opposing first and second grooves the swivel coupling is completed and the first groove and the second groove (i.e. the first coupling element and the second coupling element) are coupled to each other. It should be understood that after insertion of the rolling bearing elements the transverse (e.g. radial) through hole is closed (e.g. by a screw).

According to a further embodiment, the catching mechanism comprises a diverter, e.g. a diverter being movable from a first position into a second position, wherein the first position corresponds to the first mode and the second position corresponds to the second mode. According to an embodiment, the movement of the first coupling element is an axial movement along the axial direction (e.g. in the first direction or the second direction) and a movement of the diverter from the first position to the second position is a movement in a third direction which is different from the axial direction (e.g. different from the first and second direction). For example, according to an embodiment, the third direction is circumferential direction corresponding to a rotational movement of the diverter crosswise the axial movement (e.g. a rotational movement about the axial direction). According to an embodiment, the diverter is coupled (e.g. axially coupled) to the first coupling element. According to an embodiment, the diverter comprises the first coupling element.

According to an embodiment, the catcher device further comprises a guiding mechanism which translates an axial movement of the diverter into the movement in the third direction (e.g. into the rotational movement). According to a further embodiment, the guiding mechanism includes a guide pin and guide groove arrangement. According to an embodiment, the guide groove is helical.

According to a further embodiment, the diverter includes an inlet and an outlet, wherein the outlet is fluidically coupled to the inlet. According to an embodiment, the diverter is configured for receiving an operation element (e.g. the first, second or third operation element) at the inlet and providing the operation element at the outlet. According to an embodiment, the transport of the operation element is effected by fluidflow (e.g. flow of drilling fluid) and/or gravity.

According to an embodiment, the catcher device further comprises a catching path and a bypass path besides the catching path. According to an embodiment, the catching path and a bypass path are parallel to each other. According to a further embodiment, in the first mode the outlet is located facing the bypass path and in the second mode the outlet is facing the catching path. A transfer between the first mode and the second mode may be accomplished by moving (e.g. rotating) with respect to each other the outlet on the one hand and the bypass path (and eventually the catching path) on the other hand. For instance, according to an embodiment, the diverter may be configured to be rotatable with respect to the catching path.

According to an embodiment, the catcher device further comprises an obstructing element, the obstructing element obstructing the catching path in the first mode. According to a further embodiment, the obstructing element is a leaf spring being bent out of the catching path in the second mode, e.g. by interaction with the diverter (e.g. by axial movement of the diverter).

According to a further embodiment, the catching mechanism is transferable from the second mode into the first mode. Accordingly, in an embodiment the catching mechanism in the second mode is resettable into the first mode for again passing by a first operation element.

According to an embodiment, a delay device is provided, the delay device delaying a transfer of the catching mechanism from the second mode into the first mode, in particular after a release of the second operation element by the downhole tool. According to a further embodiment, the delay time is equal to or larger than the travel time the second operation element takes from its release by the downhole tool until its catch by the catching mechanism.

According to a further embodiment, at least one third operation element is released by the downhole tool in the course of the release of the second operation element and the delay time is configured to be sufficient to also catch also the at least one third operation element by the catching mechanism. According to an embodiment, the delay time (by which the transfer of the catching mechanism from the second mode into the first mode is delayed) is adapted to catch the second operation element and the at least one third operation elements before the return to the first mode. According to an embodiment, the second operation element is an activating element (for activating the downhole tool) and the at least one third operation element is a deactivating element (for a deactivating the downhole tool).

For example, according to an embodiment the delay device is part of the catcher device, i.e. the catcher device further comprises the delay device. According to a further embodiment, the delay device delays a transfer of the catching mechanism from the second mode into the first mode upon the return movement of the first coupling element. In other words, according to an embodiment in response to a return movement of the first coupling element a transfer of the catching mechanism from the second mode into the first mode is delayed by the delay time which is defined by the delay device. Hence, according to an embodiment, even after the beginning of the return movement of the first coupling element the catching mechanism still remains in the second mode for the delay time, thus enabling to catch the second operation element which needs some time (the travel time) to travel from the downhole tool to the catcher device after release of the second operation element from the downhole tool. According to a further embodiment, the release of the second operation element from the downhole tool triggers the return movement of the first coupling element.

According to an embodiment, the delay device comprises a bias element biasing the guiding mechanism such that upon a return movement of the first coupling element in a return direction, opposite the first direction, the guiding mechanism follows the movement of the coupling element, thus delaying a return from the second position to the first position. In accordance with an embodiment, the return from the second position to the first position includes a rotational return movement of the diverter and the catching path with respect to each other.

According to a further embodiment, the delay device is part of the downhole tool (in other words, the downhole tool comprises the delay device). In particular, if being part of the downhole tool the delay device may be configured to delay a transfer of the catching mechanism from the second mode into the first mode upon a return movement of a moveable element of the downhole tool. In other words, according to an embodiment, in response to a return movement of the moveable element of the downhole tool a transfer of the catching mechanism from the second mode into the first mode is delayed by the delay time which is defined by the delay device. Hence, according to an embodiment even after initiating a return movement of the moveable element the catching mechanism still remains in the second mode for the delay time. For example, according to an embodiment, the delay device is configured to delay a movement of the second coupling element of the downhole tool upon a return movement of the moveable element of the downhole tool. According to a further embodiment, the delay device is configured to delay a movement of the first coupling element of the downhole tool upon a return movement of the moveable element of the downhole tool.

According to a further embodiment, the downhole tool and the catcher device each may comprise a delay device.

According to an embodiment, the delay device may be separable from the downhole tool and/or from the catcher device. For example, according to an embodiment the delay device is configured to be mountable between the first coupling element of the catching mechanism and the second coupling element of the downhole tool. For example, in an embodiment the coupling of the first coupling element and the second coupling element is effected via the delay device, e.g. by mounting the delay device to the first coupling element and to the second coupling element.

According to an embodiment the delay device is slowing down a movement of at least one element coupled with the catching mechanism (e.g. the movable element of the downhole tool, the first coupling element, or the second coupling element) or of at least element that is part of the catching mechanism (e.g. the relative movement of the diverter and the catcher cage). For example, in such an embodiment the delay device may be hydraulically operated (e.g. operating similar to a hydraulic damper). However, additionally or alternatively electromagnetic and/or mechanical slowing down of the movement of the at least one element is also possible. In accordance with an embodiment the catching mechanism is configured so as to perform a change from the first mode to the second mode or vice versa in response to the movement of the at least one element. According to a further embodiment, the catching mechanism is configured so as to perform the change from the first mode to the second mode or vice versa only within a portion of the movement of the at least one element, e.g. within an end portion of the movement of the at least one element. According to an embodiment, the portion of the movement may be for example in a range between the last 5%-50% of the movement of the at least one element (e.g. of the relative movement of the catcher cage with respect to the diverter).

According to a further embodiment, the catcher device comprises a catcher cage, in particular within the hollow body of the catcher device (i.e. within the hollow catcher body). According to an embodiment, the catcher cage is axially movable with respect to the hollow catcher body. In accordance with an embodiment, the catcher cage is configured for catching and retaining the second operation element. According to a further embodiment, the catcher cage is configured for catching and retaining the at least one third operation element.

According to an embodiment, the diverter and the catcher cage are configured to be rotatable with respect to each other. For example, according to an embodiment, the diverter is rotatably mounted to the catcher cage. According to a further embodiment, the guiding mechanism is partially provided by the catcher cage. For example, in an embodiment the guiding mechanism is provided by the diverter and the catcher cage.

According to an embodiment, the downhole tool is activatable by the second operation element. For example, according to a further embodiment the downhole tool is a multiple activation bypass tool, i.e. a tool which is capable of being activated to provide a bypass flow into an annulus around the downhole tool and wherein the tool is capable of being activated (providing bypass flow) multiple times. According to an embodiment, the downhole tool is activatable by the second operation element (e.g. a deformable ball or a deformable dart) and is deactivatable (i.e. to stop bypass flow) by a third operation element (e.g. a steel ball). According to a further embodiment, the downhole tool is activatable and the activatable by the same type of operation element (second operation element).

According to embodiments of the herein disclosed subject matter, the downhole tool may be configured in any degree of detail described in one or more of the following patents and patent applications: U.S. Pat. Nos. 4,889,199, 5,499,687, US 2006/0113115, WO 2006/134446, WO 02/14650, US 2007/0107944 A1, WO 2011/061239, WO 2013/092532, PCT application No. PCT/EP2017/071251.

In the above there have been described and in the following there will be described exemplary embodiments of the subject matter disclosed herein with reference to a downhole catcher device, a downhole tool, a tool and catcher combination and a method. It has to be pointed out that of course any combination of features relating to different aspects of the herein disclosed subject matter is also possible. In particular, some features have been or will be described with reference to device type embodiments whereas other features have been or will be described with reference to method type embodiments. However, a person skilled in the art will gather from the above and the following description that, unless otherwise notified, in addition to any combination of features belonging to one aspect also any combination of features relating to different aspects or embodiments, for example even combinations of features of device type embodiments and features of the method type embodiments are considered to be disclosed with this application. In this regard, it should be understood that any method feature derivable from a corresponding explicitly disclosed device feature should be based on the respective function of the device feature and should not be considered as being limited to device specific elements disclosed in conjunction with the device feature. Further, it should be understood that any device feature derivable from a corresponding explicitly disclosed method feature can be realized based on the respective function described in the method with any suitable device disclosed herein or known in the art.

The aspects and embodiments defined above and further aspects and embodiments of the herein disclosed subject matter are apparent from the examples to be described hereinafter and are explained with reference to the drawings, but to which the invention is not limited. The aforementioned definitions, comments and explanations are in particular also valid for the following detailed description and vice versa. Further, the aforementioned examples and embodiments are combinable with the examples and embodiments described hereinafter and vice versa.

DETAILED DESCRIPTION

Figure 1:
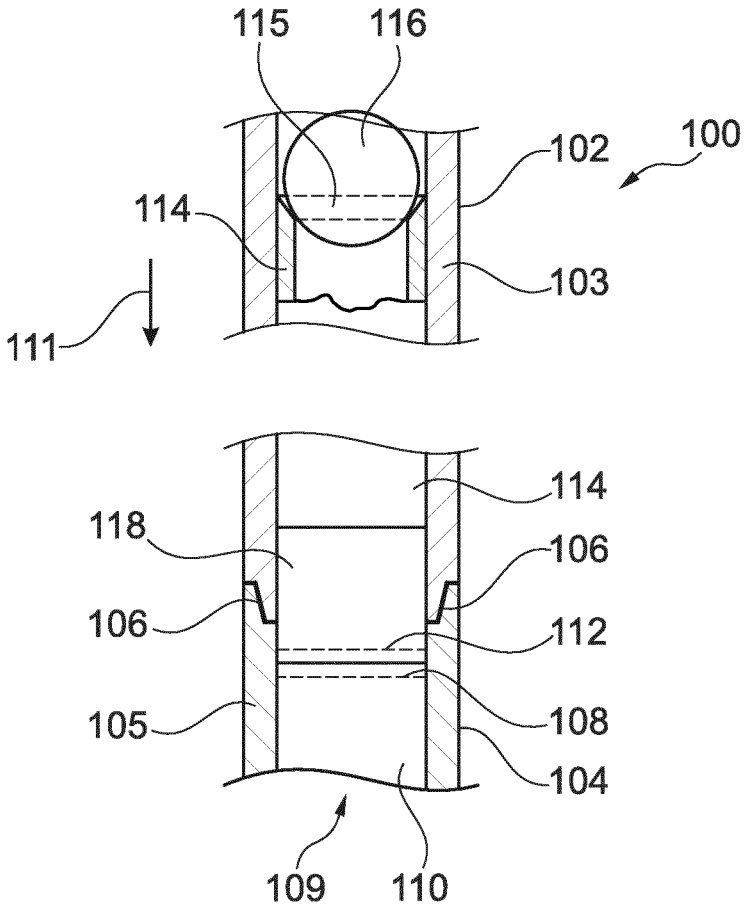
FIG. 1 shows a cross-sectional view of a tool and catcher combination according to embodiments of the herein disclosed subject matter.

The illustration in the drawings is schematic. It is noted that in different figures, similar or identical elements are provided with the same reference signs or with reference signs which differ only in the first digit. Accordingly, the description of the similar or identical features is not repeated in the description of subsequent figures in order to avoid unnecessary repetitions. Rather, it should be understood that the description of these features in the preceding figures is also valid for the subsequent figures unless explicitly noted otherwise.

FIG. 1 shows a cross-sectional view of a tool and catcher combination 100 according to embodiments of the herein disclosed subject matter.

According to an embodiment, the tool and catcher combination 100 comprises a downhole tool 102, for example a multiple activation circulation tool, and a downhole catcher device 104. In accordance with an embodiment, the downhole tool 102 and the downhole catcher device 104 form part of a string, for example a drillstring or a coiled tubing. According to an embodiment, the downhole tool 102 and the catcher device 104 are mounted/mountable to each other, e.g. by threads 106. According to an embodiment, the downhole tool 102 comprises a hollow tool body 103 and the catcher device 104 comprises a hollow catcher body 105. According to an embodiment, the threads 106 are provided on the hollow tool body 103 and on the hollow catcher body 105.

According to an embodiment, the catcher device 104 comprises a first coupling element 108 movable with respect to (e.g. moveable within) the hollow catcher body 105. According to an embodiment, a movement of the first coupling element 108 transfers a catching mechanism 109 from a first mode to a second mode. According to an embodiment, the catching mechanism 109 comprises a movable element 110 (also referred to as first moveable element; e.g. an axially moveable element or a diverter, embodiments of which are described later in greater detail). According to a further embodiment, the first coupling element 108 is attached to or provided by the first movable element 110 of the catcher device. In accordance with embodiments of the herein disclosed subject matter, the term "axially movable" means movable in an axial direction 111, i.e. parallel to a longitudinal axis of the string.

According to a further embodiment, the downhole tool 102 comprises a second coupling element 112 movable with respect to (e.g. moveable within) the hollow tool body 103. According to an embodiment, the downhole tool 102 further comprises a movable element 114 (partially shown in sectional view in FIG. 1; also referred to as second moveable element; e.g. an axially moveable activation sleeve). According to an embodiment, the movable element 114 is coupled to (e.g. comprises) a seat 115 for receiving an operation element (which is also referred to as second operation element 116; shown in phantom view in FIG. 1). According to an embodiment, the second operation element 116 is introduced into the string at the surface of the earth and pumped down to land on the seat 115 to thereby allow to shift the movable element 114 by fluid pressure exerted on the second operation element 116. According to an embodiment, the movable element 114 of the downhole tool 102 comprises openings (not shown in FIG. 1) that may be aligned with a bypass ports in the hollow tool body 103 to thereby activate the tool and provide a bypass circulation to an annulus (not shown in FIG. 1) around the hollow tool body 103. According to an embodiment, the second operation element 116 may be a ball, a dart or any other element suitable for the desired purpose.

According to an embodiment, the first coupling element 108 and the second coupling element 112 are coupleable (or coupled) with each other so as to transfer forces (e.g. axial forces and/or rotational forces (torques)) between the first coupling element 108 and the second coupling element 112 in the axial direction 111. According to an embodiment, the first coupling element 108 and the second coupling element 112 are coupleable (or coupled) by a swivel coupling. According to a further embodiment, the first movable element 110 of the catcher device 104 and the movable element 114 of the downhole tool 102 are coupleable (coupled) via the first coupling element 108 and the second coupling element 112 so as to transfer forces in the axial direction 111 between the first movable element 110 and the movable element 114.

According to an embodiment, the tool and catcher combination 100 comprises a delay device 118 which delays a transfer of the catching mechanism 109 from the second mode into the first mode. According to an embodiment, the delay device 118 is configured to delay the transfer of the catching mechanism 109 from the second mode into the first mode with respect to the movement of the movable element 114. For example, according to an embodiment the second operation element 116 is removed from the seat 115 by pushing (shearing) the second operation element 116 through the seat 115. Upon release of the second operation element, the second operation element does not exert a force on the movable element 114. According to an embodiment this allows the movable element 114 to return to its closed position (e.g. by action of by bias element). Although the second operation element 116 needs some time to travel from the seat 115 to the catching mechanism 109, the delay device ensures that the catching mechanism 109 is long enough in the second mode to catch the second operation element 116.

According to an embodiment, the delay device is coupled with the catching mechanism to delay the transfer from the second mode into the first mode.

According to an embodiment, the delay device 118 is part of the downhole tool 102. According to a further embodiment, the delay device 118 is coupled to (e.g. attached to) the movable element 114 of the downhole tool 102. According to an embodiment, the delay device 118 is coupled to (e.g. comprises) the second coupling element 112.

In accordance with embodiments of the herein disclosed subject matter, in the second mode any operation element, e.g. the second operation element 116, is caught by the catching mechanism whereas in the first mode operation elements are passed by (are not caught by the catching mechanism).

Figure 2:
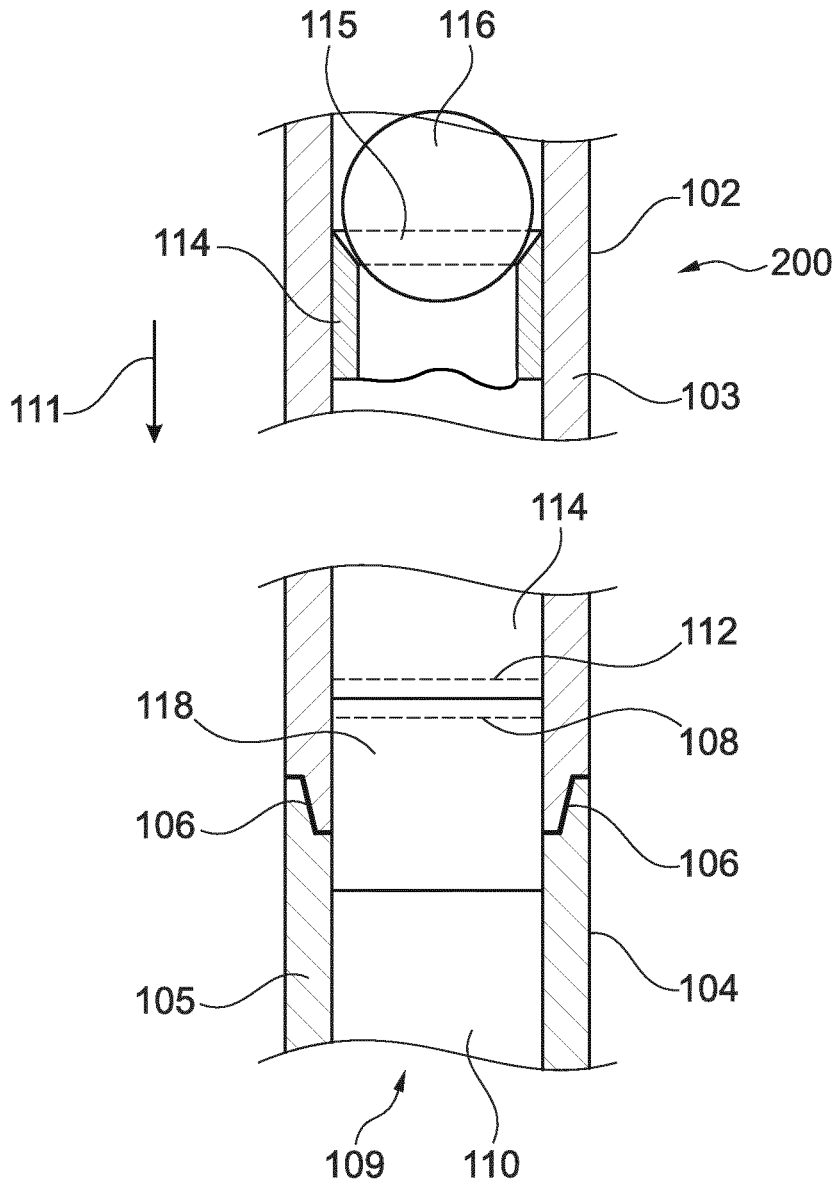
FIG. 2 shows another tool and catcher combination according to embodiments of the herein disclosed subject matter.

FIG. 2 shows another tool and catcher combination 200 according to embodiments of the herein disclosed subject matter.

Except for the delay device, the tool and catcher combination 200 is similar to the tool and catcher combination 100 shown in FIG. 1.

According to a further embodiment the delay device 118 is part of the catcher device 104. For example, according to an embodiment the delay device 118 is coupled to (e.g. attached to) the first movable element 110 of the catcher device. According to a further embodiment, the delay device is coupled to (e.g. comprises) the first coupling element 108. However, the delay device may be located at any other suitable location, e.g. opposite the first coupling element 108.

Figure 3:
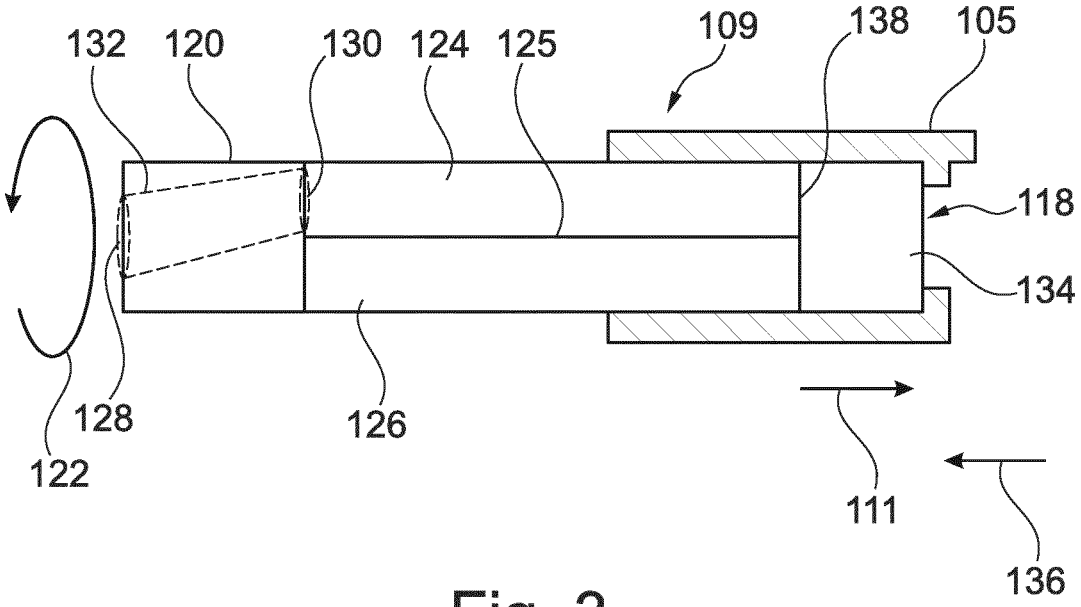
FIG. 3 shows a catching mechanism according to embodiments of the herein disclosed subject matter.

FIG. 3 shows a catching mechanism 109 according to embodiments of the herein disclosed subject matter.

According to an embodiment, the catching mechanism comprises a diverter 120 the diverter being movable from a first position (corresponding to the first mode) into a second position (corresponding to the second mode) and vice versa. According to an embodiment, the catcher device 109 comprises a catching path 124 and a bypass path 126 separated by a cage portion 125. The diverter 120 includes an inlet 128 and an outlet 130 which are fluidically coupled, e.g. by a flow path as indicated by the dashed lines at 132. The inlet 128 is fluidically coupled to the downhole tool 102 (not shown in FIG. 3) in particular so as to allow the second operation element 116 to pass from the downhole tool 102 to the inlet 128.

According to an embodiment, the transfer of the catching mechanism 109 between the first position and the second position is performed by rotation of the diverter 120 with respect to the catching path 124. According to an embodiment, the diverter is configured for rotation in a plane which is crosswise the axial direction 111, e.g. in a circumferential direction indicated at 122 in FIG. 3. According to an embodiment, the rotation of the diverter with respect to the catching path 124 is effected by rotationally coupling the diverter to a rotating member (of the catcher device or of the downhole tool). According to a further embodiment, the rotation of the diverter with respect to the catching path 124 is effected by axial movement of the diverter 120 and a guiding mechanism (not shown in FIG. 3) which translates the axial movement into the rotation of the diverter 120 with respect to the catching path 124 (i.e. into a rotational movement).

According to an embodiment, the delay device 118 comprises a bias element 134 which biases the catching path 124

(or the catcher cage which defines the catching path 124) and, in an embodiment (and depending on the relative position) also the diverter 120, into a return direction 136, i.e. in a direction corresponding to a transfer from the second mode into the first mode.

According to an embodiment, the return direction 136 is parallel to the axial direction 111 and corresponds to the direction in which the movable element 114 of the downhole tool 102 returns from an activated position (e.g. with the operation element 116 in the seat 115) to a deactivated position (e.g. without operation element 116 in the seat 115). The bias element 134 may be a spring or any other suitable device and may be mounted between the catcher cage and the hollow catcher body 105. According to an embodiment, the delay device 118 (and in particular the bias element 134) is located downstream the catching path 124, i.e. at an end face 138 of the catching path 124 that is opposite diverter 120, e.g. as shown in FIG. 3. According to other embodiments, the delay device 118 (e.g. the bias element 134) may be located in any other suitable location. Axially biasing the catching path 124 in the return direction 136 has the technical effect that that upon a return movement of the diverter 120 the catching path follows this return movement and hence the diverter 120 and the catching path 124 do not move with respect to each other. As long as no such relative movement of the diverter 120 and the catching path 124 occurs, no transfer between modes occurs, i.e. the second mode of the catching mechanism is maintained. Only if the catching path 124 is hindered in following the movement of the diverter 120 (e.g. by a mechanical constraint such as a stop face or by mechanical constraints (e.g. a maximum extension) of the bias element), a transfer from the second mode into the first mode occurs.

According to a further embodiment, the catching path 124 is not axially biased but is rotationally biased in a rotational return direction that corresponds to a transfer from the second mode into the first mode. Such a rotational biasing may be effected for example by a torque exerting spring (mounted e.g. between the catching path 124/catcher cage and the hollow catcher body 105.

Based on the aforementioned principles, embodiments and examples, in the following a more detailed example an implementation of the herein disclosed subject matter is provided. In particular, the operation of a catcher device according to embodiments of the herein disclosed subject matter is described. However, a person of ordinary skill in the art will understand that particular embodiments described hereinafter may be replaced by alternative embodiments described above without departing from the scope of the herein disclosed subject matter.

Figure 4:
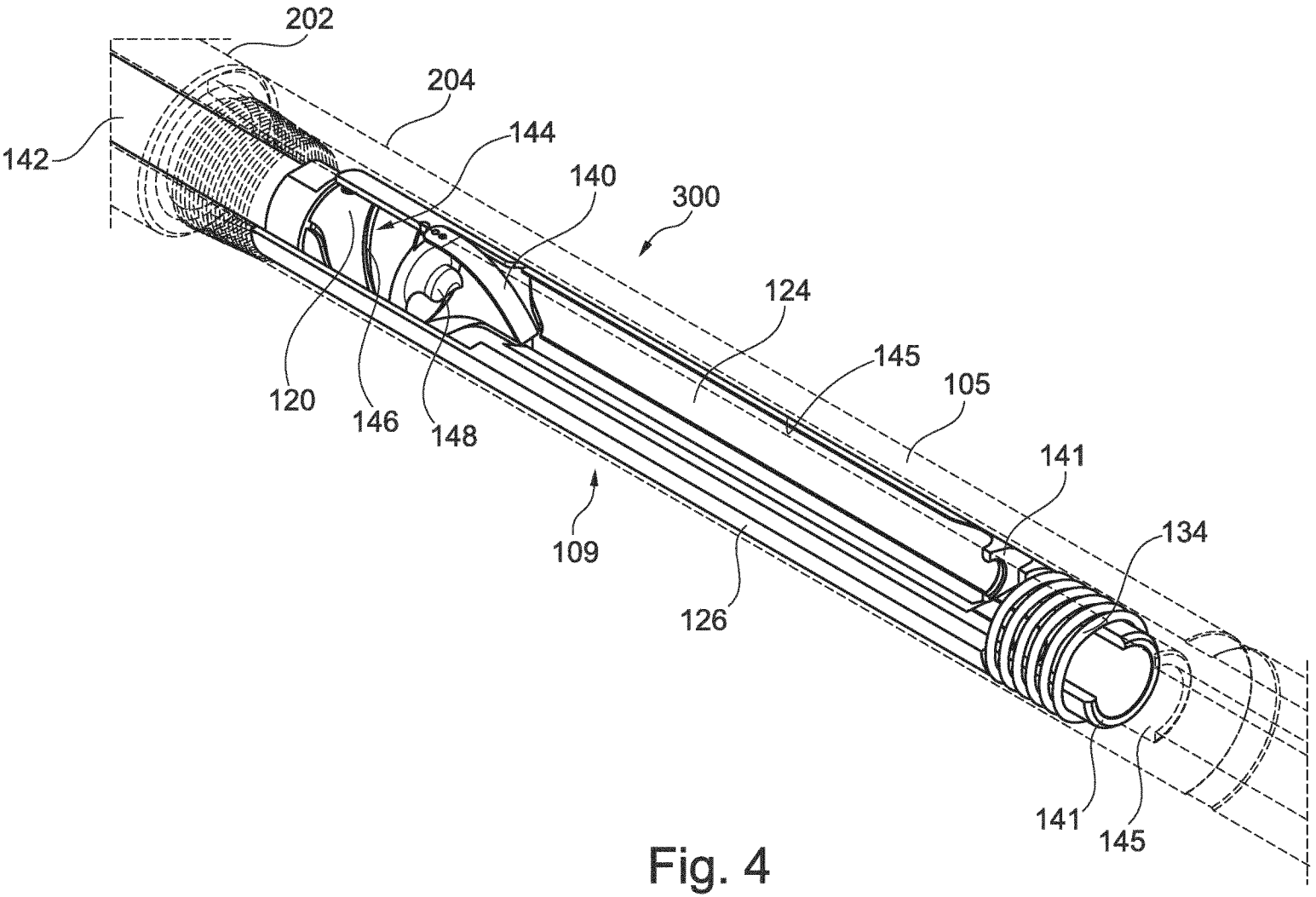
FIG. 4 shows a further tool and catcher combination with a catcher device and a downhole tool according to embodiments of the herein disclosed subject matter.

FIG. 4 shows a further tool and catcher combination 300 with a catcher device 204 and a downhole tool 202 according to embodiments of the herein disclosed subject matter. It is noted that in FIG. 4 some of the elements depicted are shown in sectional view.

The catcher device 204 comprises a catching mechanism 109 according to embodiments of the herein disclosed subject matter. In particular, the catching mechanism 109 comprises a diverter 120, a catching path 124, a bypass path 126 and a bias element 134 as delay device. Further, in accordance with an embodiment the catcher device 204 comprises an obstructing element 140 in the form of a leaf spring. In the first mode of the catcher device 204 the obstructing element 140 is obstructing the catching path 124.

According to an embodiment, the catching path 124 and the bypass path 126 are defined by a catcher cage 141. According to a further embodiment, the catcher cage 141 is located in a cavity 145 of a hollow catcher body 105.

According to a further embodiment, the bias element 134 is biasing the catcher cage 141 and hence the catching path 124 upwardly (i.e. in upstream direction). According to an embodiment, the diverter 120 and the catcher cage 141 are configured to rotate freely in the cavity 145.

According to an embodiment, the downhole tool 202 comprises an elongation element 142 which is coupled between the diverter 120 and the movable element 114 (not shown in FIG. 4) of the downhole tool 102. In this way, by using an elongation element with appropriate length, conventional downhole tools may be adapted for use with the catcher device according to embodiments of the herein disclosed subject matter.

In accordance with an embodiment, the catcher device 204 further comprises a guiding mechanism 144 which translates an axial movement of the diverter 120 with respect to the bypass path 126 (i.e. with respect to the catcher cage 141 in an embodiment) into a rotational movement of the diverter 120 with respect to the bypass path 126. In accordance with an embodiment, the guiding mechanism 144 includes a groove 146 in the diverter 120 and a guide pin of the catcher cage 141 running in the groove 146 (the guide pin is not shown in FIG. 4). According to an embodiment, the guide pin is fixedly coupled with the bypass path (e.g. is provided at the catcher cage 141).

According to an embodiment, the diverter 120 includes a protrusion 148 which obstructs the bypass path 126 in the second position whereas the obstructing element 140 obstructs the catching path 124 in the first position of the catching mechanism 109.

Figure 5:
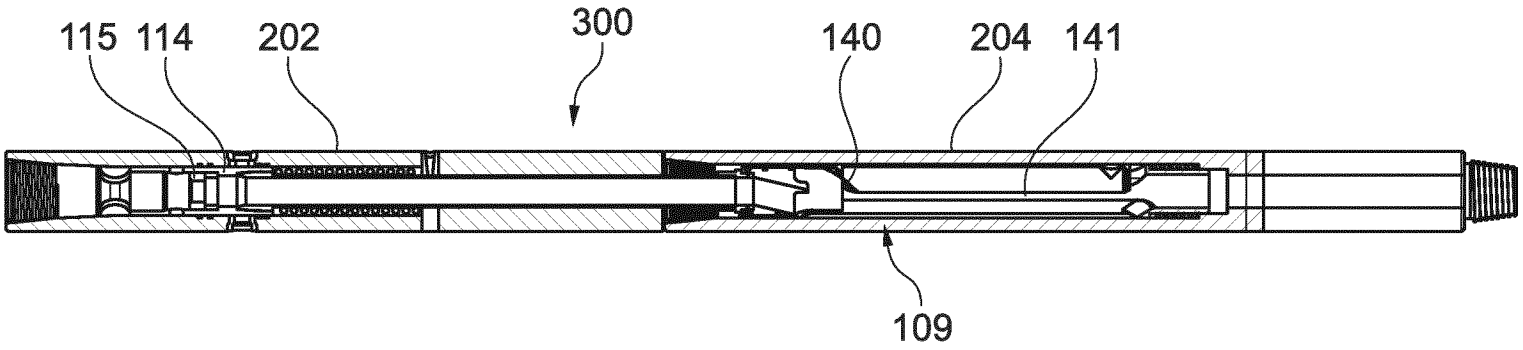
FIG. 5 shows a cross-sectional view of the tool and catcher combination of FIG. 4 in its entirety.

FIG. 5 shows a cross-sectional view of the tool and catcher combination 300 of FIG. 4 in its entirety.

In FIG. 5, the catching mechanism 109 is in its first mode, i.e. the catching mechanism 109 is configured for passing by a first operation element (not shown in FIG. 5). According to an embodiment, the first operation element is an operation element that is capable of passing through the seat 115 of the downhole tool 202 without activating the movable element 114.

Figure 6:
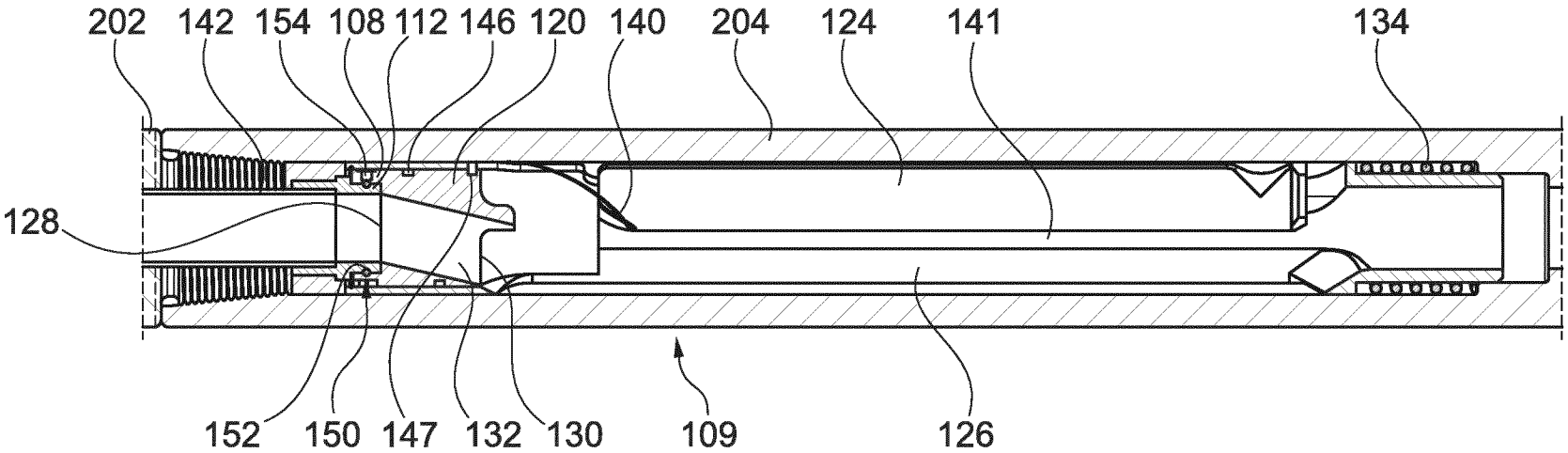
FIG. 6 shows in cross-sectional view the catcher device of FIG. 5 in greater detail.

FIG. 6 shows in cross-sectional view the catcher device 204 of FIG. 5 in greater detail. The catcher device 204 comprises a first coupling element 108 and the downhole tool 202 comprises a second coupling element 112 according to embodiments of the herein disclosed subject matter. According to an embodiment, the first coupling element 108 and the second coupling element 112 form part of a swivel coupling 150. In accordance with an embodiment, due to the swivel coupling 150 the diverter 120 is capable of rotating freely with respect to the elongation element 142 and with respect to the second coupling element 112.

According to an embodiment, the diverter 120 comprises a guiding mechanism in the form of at least one guide groove 146 and at least one corresponding guide pin 147 of a guide pin and guide groove arrangement. For example, according to an embodiment the guide pin and guide groove arrangement comprises two or more guide grooves 146 and the two or more guide pins 147, e.g. three guide grooves 146 and three guide pins 147. Two or more guide pins and guide grooves reduce the mechanical load on each guide pin and guide groove and may reduce an uneven load on the diverter 120.

In accordance with an embodiment, the swivel coupling 150 includes rolling bearing elements 152 such as balls which are inserted into the space between the first coupling element 108 and the second coupling element 112 through a through hole in the diverter 120 which is closed by a screw 154.

In accordance with an embodiment, in the first mode the flow path 132 between the inlet 128 of the diverter and the outlet 130 of the diverter guides the first operation element to the outlet 130 and to the bypass path 126. In particular, in the first mode the outlet 130 is facing the bypass path 126. Further, in order to prevent the first operation element from entering the catching path 124 in the first mode the obstructing element 140 is obstructing the inlet to the catching path 124.

Figure 7:
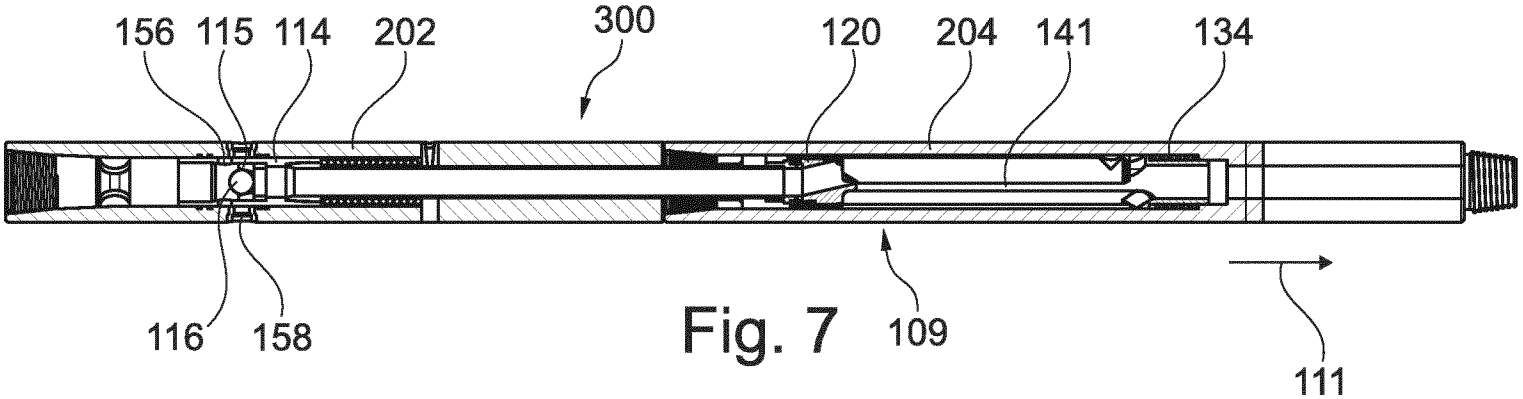
FIG. 7 shows the tool and catcher combination of FIG. 5 with the catching mechanism in the second mode.

FIG. 7 shows the tool and catcher combination 300 of FIG. 5 with the catching mechanism 109 in the second mode.

In accordance with an embodiment, fluid pressure acting on a second operation element 116 in the seat 115 has moved the movable element 114 downwardly, i.e. in the downward direction which corresponds to the axial direction 111 shown in FIG. 7. This downward movement of the movable element 114 has shifted the diverter 120 downwardly with respect to the catcher cage 141 which is biased into its initial (upper) position by the bias element 134. Due to the guiding mechanism 146, 147 this downward (axial) movement of the diverter 120 also results in a rotation of the diverter 120 and hence in the transfer into the second mode (which is shown in FIG. 7).

It is noted that in FIG. 7 the bias element 134 is uncompressed and the through holes 156 in the movable element 114 do not overlap with the bypass ports 158 of the bypass tool 202.

Figure 8:
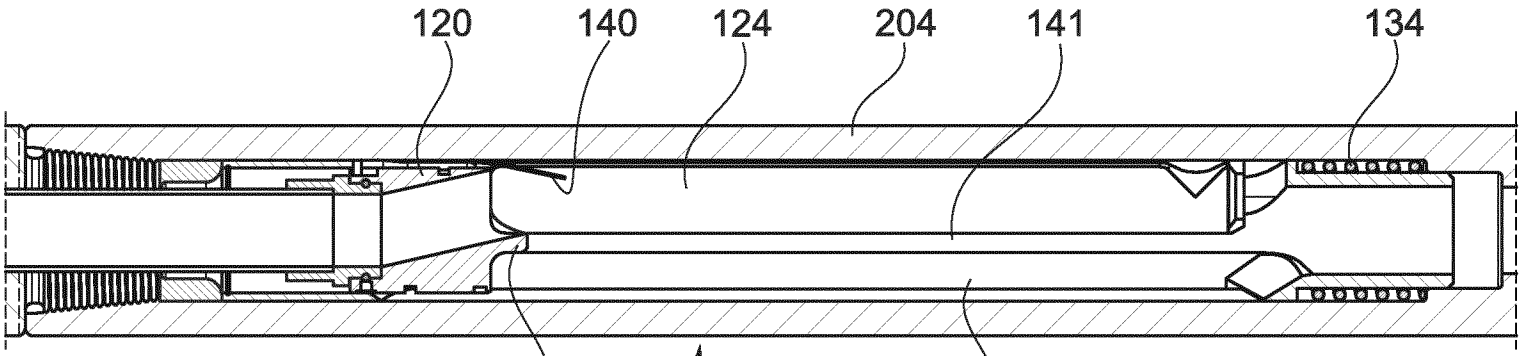
FIG. 8 shows in cross-sectional view the catcher device of FIG. 7 in greater detail.

FIG. 8 shows in cross-sectional view the catcher device 204 of FIG. 7 in greater detail. In accordance with an embodiment, the downward movement of the diverter 120 towards the catcher cage 141 forces the obstructing element 140 out of the catching path 124 whereas the protrusion 148 obstructs the bypass path 126 to prevent an operation element, in particular the second operation element 116 (see FIG. 7), passing through the diverter 120, from entering the bypass path 126 in the second mode.

Figure 9:
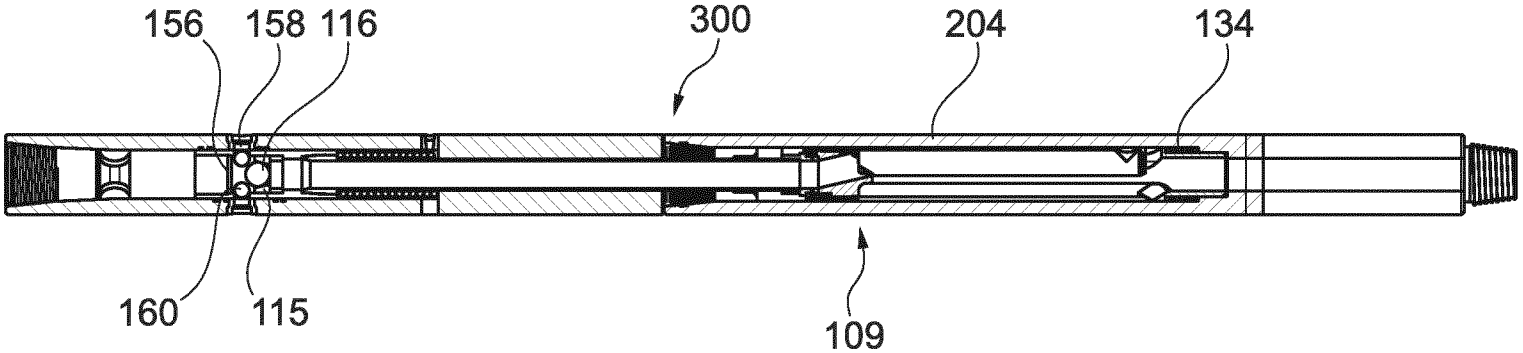
FIG. 9 shows the tool and catcher combination of FIG. 5 with the catching mechanism in the second mode and the bias element compressed.

FIG. 9 shows the tool and catcher combination 300 of FIG. 5 with the catching mechanism 109 in the second mode and the bias element 134 compressed. In the position shown in FIG. 9 the through holes 156 in the movable element 114 overlap with the bypass ports 158. In accordance with an embodiment, third operation elements 160 have been introduced into the string and obstruct the through holes 156, thereby blocking or at least reducing bypass flow. The third operation elements 160 (which in an embodiment are sometimes referred to as deactivation balls) allow for an increase of the pressure upstream the second operation element 116 and therefore allow the second operation element 116 to be forced through the seat 115.

Figure 10:
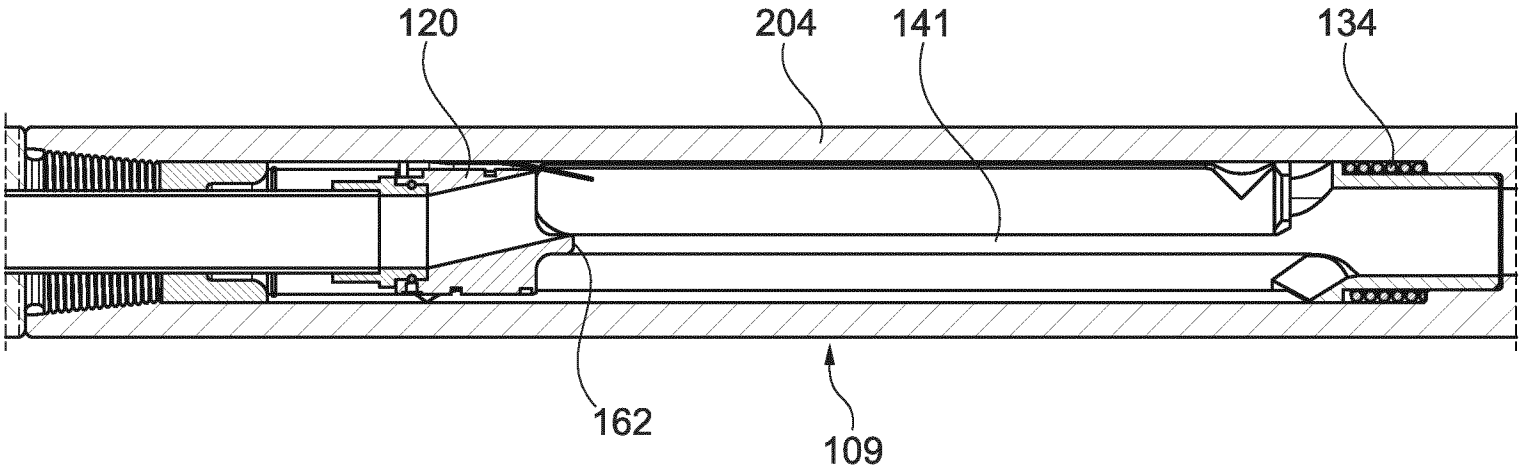
FIG. 10 shows in cross-sectional view the catcher device of FIG. 9 in greater detail.

FIG. 10 shows in cross-sectional view the catcher device 204 of FIG. 9 in greater detail. Compared to FIG. 8 it can be seen that the diverter 120 as well as the catcher cage 141 together have been shifted further downwardly, thereby compressing the bias element 134. This movement of the diverter 120 and the catcher cage 141 together may be effected by abutting faces of both elements, e.g. faces which are abutting in the circumferential direction and/or faces which are abutting in axial direction, such as the faces indicated at 162 in FIG. 10. According to an embodiment, the abutting faces prevent further rotation of the diverter, thus transferring a downward force (the downward movement of the moveable element 114) to the bias element 134 which is thus compressed.

Figure 11:
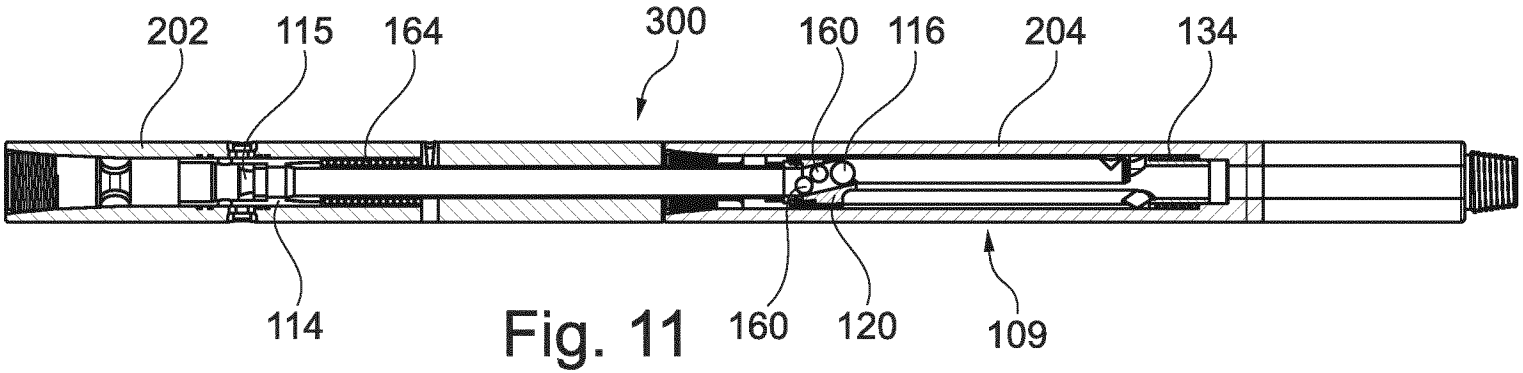
FIG. 11 shows the tool and catcher combination of FIG. 5 with the catching mechanism in the second mode and the bias element expanded.

FIG. 11 shows the tool and catcher combination 300 of FIG. 5 with the catching mechanism 109 in the second mode and the bias element 134 expanded.

Figure 12:
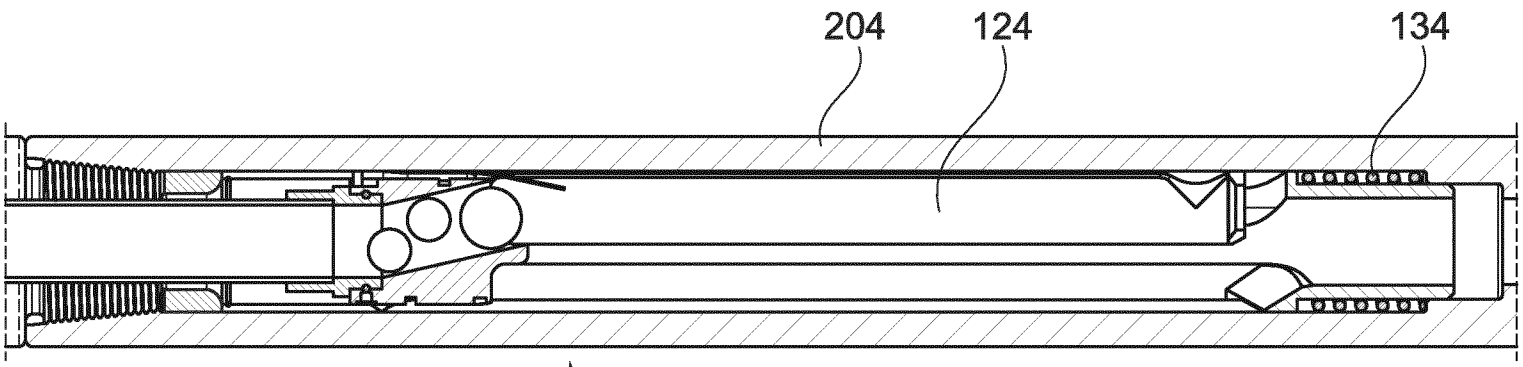
FIG. 12 shows in cross-sectional view the catcher device of FIG. 11 in greater detail.

After pushing in the second operation element 116 through the seat 115, the third operation elements 160 follow the second operation element 116 downstream, i.e. in a direction towards the catcher device 204. Further, after pushing the second operation element 116 through the seat 115, the downward force on the moveable element 114 at least reduces and hence the movable element 114 moves in upstream direction under the action of a bias element 164 of the downhole tool 202. Due to the axial coupling of the diverter 120 to the movable element 114, also the diverter 120 moves upward, together with the movable element 114. However, due to the expanding bias element 134 which effects the catcher cage 141 to follow the upward movement of the diverter 120, for a certain amount of upward movement (e.g. for the expansion length of the bias element 134) the relative position of the diverter 120 and the catcher cage 141 does not change. Further, as long as the catcher cage 141 follows the upward movement of the diverter 120 (i.e. as long as the relative position of the diverter 120 and the catcher cage 141 does not change) the catching mechanism 109 does not change mode from the second mode to the first mode. Therefore, the time duration during which the catcher cage 141 follows the upward movement of the diverter 120 is also referred to as delay time herein. Viewed differently, the delay device embodied by the bias element 134 delays the transfer of the catching mechanism from the second mode into the first mode after the triggering of the return movement (upward movement) of the movable element 114 of the downhole tool. This allows the second operation element 116 and, if present, the at least one third operation element 160 to enter the catching path 124 before the catching mechanism 109 of the catcher device 204 returns to the first mode, as shown in greater detail in FIG. 12.

Figure 13:
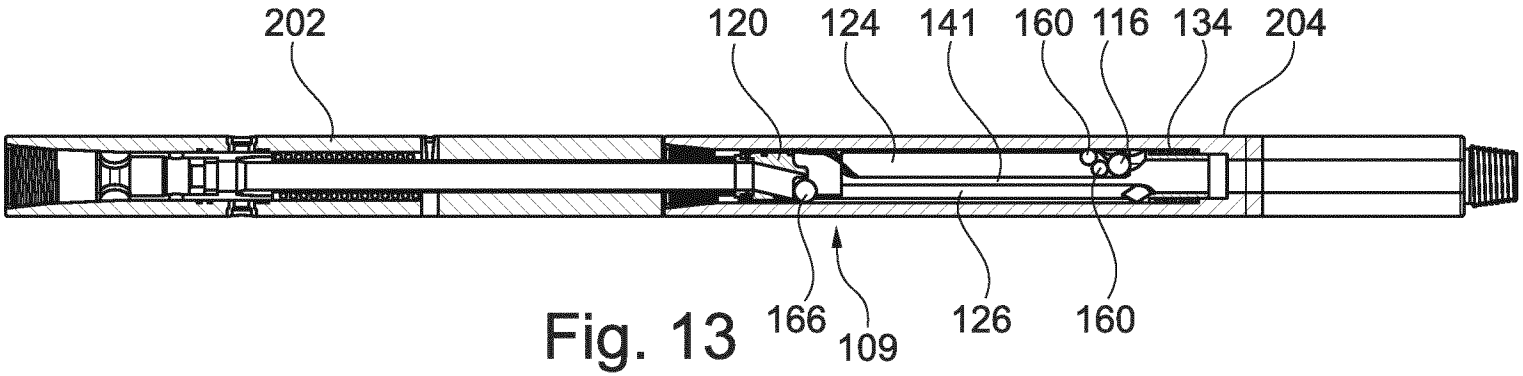
FIG. 13 shows the tool and catcher combination of FIG. 5 with the catching mechanism again in the first mode.

FIG. 13 shows the tool and catcher combination 300 of FIG. 5 with the catching mechanism 109 again in the first mode. After expansion of the bias element 134 a further upward movement of the diverter 120 results in a relative movement of the diverter 120 and the catcher cage 141 with respect to each other which transfers the catching mechanism 109 from the second mode again into the first mode, as shown in FIG. 13.

Again in the first mode, the catching mechanism retains the second and third operation elements 116, 160 in the catching path 124 while allowing a first operation element 166 to enter the bypass path 126, and to thereby bypass the catching path 124 to operate for example a downhole tool downstream the catcher device 204.

Figure 14:
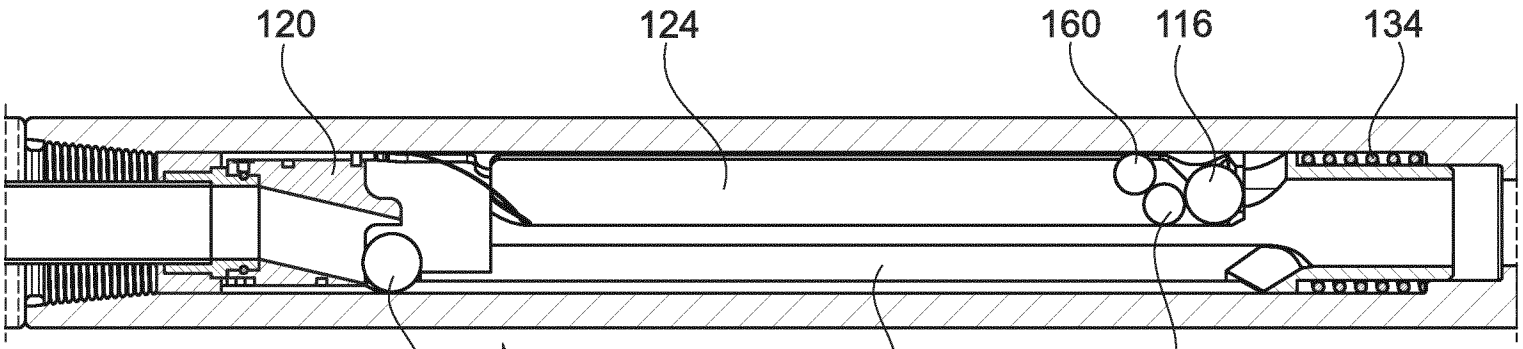
FIG. 14 shows in cross-sectional view the catcher device of FIG. 13 in greater detail.

FIG. 14 shows in cross-sectional view the catcher device 204 of FIG. 13 in greater detail.

Figure 15:
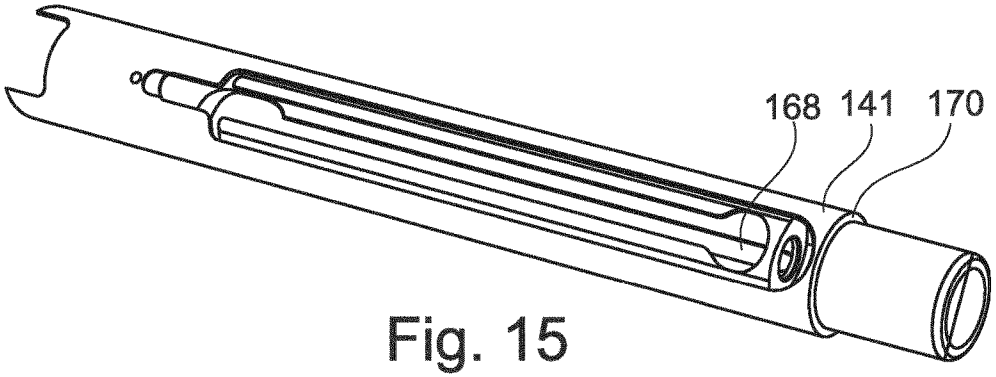
FIG. 15 shows the catcher cage of the catcher device of FIG. 5 in greater detail.

FIG. 15 shows the catcher cage 141 of the catcher device 204 of FIG. 5 in greater detail. According to an embodiment, the catcher cage comprises a removal hole 168 through which the catched operation elements 116, 160 can be removed from the catcher cage (after removal of the catcher cage 141 from the hollow catcher body 105). Further, according to an embodiment the catcher cage 141 comprises an end face 170, e.g. an end face 170 pointing in axial direction on which the bias element 134 is configured to act upon. In other embodiments, the end face 170 can be located in a different location on the catcher cage 141.

Figure 16:
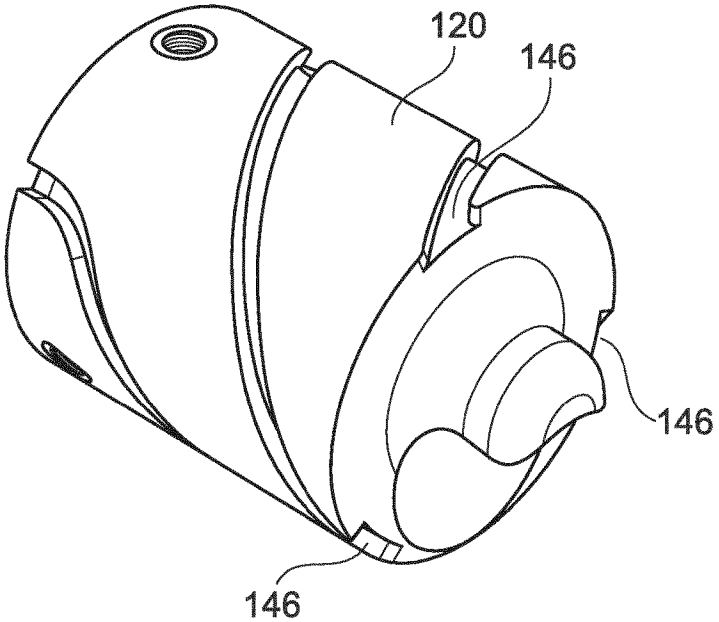
FIG. 16 shows the diverter of the catcher device of FIG. 6 in greater detail.

FIG. 16 shows the diverter 120 of the catcher device 204 of FIG. 6 in greater detail. According to an embodiment, the diverter comprises three guide grooves 146 which are equally spaced over the circumference of the diverter 120.

Figure 17:
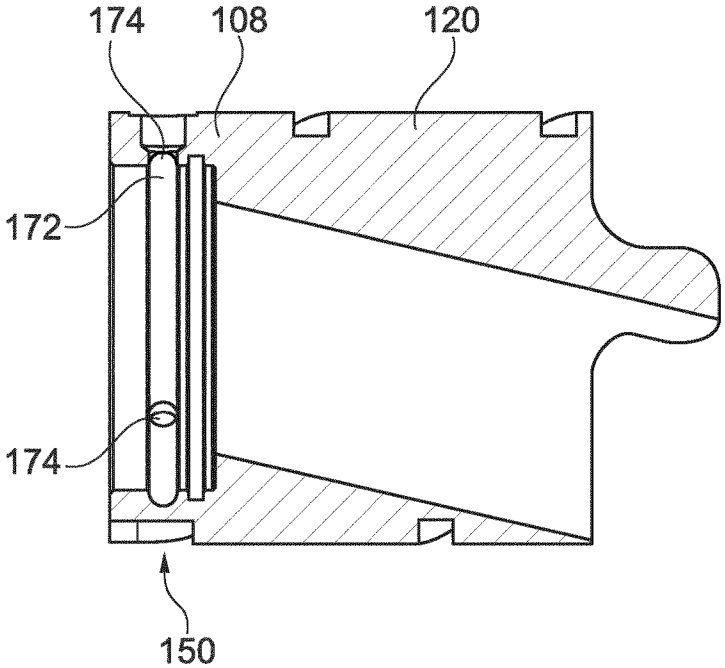
FIG. 17 shows a cross-sectional view of the diverter of FIG. 6 in greater detail.

FIG. 17 shows a cross-sectional view of the diverter 120 of FIG. 6 in greater detail. In particular, in accordance with an embodiment the diverter 120 comprises the first coupling element 108 which comprises a groove 172 of the swivel coupling 150. According to a further embodiment, the first coupling element 108 comprises at least one through hole 174 through which rolling bearing elements of the swivel coupling 150 can be inserted into the groove 172 (rolling bearing elements are not shown in FIG. 17).

It should be noted that any entity disclosed herein (e.g. components, elements and devices) are not limited to a dedicated entity as described in some embodiments. Rather, the herein disclosed subject matter may be implemented in various ways and with various granularity on device level or method step/function level while still providing the specified functionality. Further, it should be noted that according to embodiments a separate entity (e.g. an element, device, etc.) may be provided for each of the functions disclosed herein. According to other embodiments, an entity (e.g. an element, device, etc.) is configured for providing two or more functions as disclosed herein. According to still other embodiments, two or more entities are configured for providing together a function as disclosed herein.

Further, although some embodiments refer to specific entities, e.g. an compression spring, it should be understood that each of these references is considered to implicitly disclose in addition a respective reference to the corresponding general term (e.g. a bias element which may be configured to act in extension or in compression, in axial direction or in rotational direction) and/or to the respective function (e.g. biasing). Also other terms which relate to specific techniques are considered to implicitly disclose the respective general term with the specified functionality.

Further, it should be noted that while the exemplary downhole tools and catcher devices in the drawings comprise a particular combination of several embodiments of the herein disclosed subject matter, any other combination of embodiment is also possible and is considered to be disclosed with this application and hence the scope of the herein disclosed subject matter extends to all alternative combinations of two or more of the individual features mentioned or evident from the text. All of these different combinations constitute various alternative examples of the invention.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

According to an embodiment the term "adapted to" includes inter glia the meaning "configured to" and vice versa.

In order to recapitulate some of the above described embodiments of the present invention one can state:

A downhole catcher device comprises a catching mechanism which is configured to be transferable between a first mode and a second mode. The catching mechanism is further configured for passing by a first operation element if the catching mechanism is in the first mode and for catching a second operation element if the catching mechanism is in the second mode. The transfer between the first and the second mode is triggered (or effected) by a downhole tool which is operated by the second operation element.

The invention claimed is:

1. A downhole catcher device, the catcher device comprising:

a catching mechanism being transferable between a first mode and a second mode:

the catching mechanism being configured for passing by a first operation element if the catching mechanism is in the first mode; and the catching mechanism being configured for catching a second operation element if the catching mechanism is in the second mode;

the catching mechanism comprising a diverter;

the catcher device further comprising a catching path and a bypass path radially adjacent to the catching path;

wherein the diverter includes an inlet and an outlet;

wherein the outlet is fluidically coupled to the inlet;

wherein in the first mode the outlet is located facing the bypass path thereby allowing the first operation element to pass through the catching mechanism; and wherein in the second mode the outlet is facing the catching path thereby directing the second operation element into the catching path and catching the operation element in the catching mechanism.

2. The catcher device according to claim 1, further comprising a first coupling element for coupling the catching mechanism to a second coupling element of a downhole tool located upstream the catching mechanism, wherein a movement of the first coupling element transfers the catching mechanism from the first mode to the second mode, in particular wherein the first coupling element forms at least part of a swivel coupling.

3. The catcher device according to claim 2, the diverter being movable from a first position into a second position wherein the first position corresponds to the first mode and the second position corresponds to the second mode; wherein the movement of the first coupling element is an axial movement in a first direction and wherein a movement of the diverter from the first position to the second position includes a rotational movement crosswise the axial movement.

4. The catcher device according to claim 3, further comprising a guiding mechanism which translates the axial movement into the rotational movement, wherein the guiding mechanism includes a guide pin and guide groove arrangement.

5. The catcher device according to claim 1 further comprising:

an obstructing element;

the obstructing element obstructing the catching path in the first mode, wherein the obstructing element is a leaf spring being bent out of the catching path in the second mode.

6. The catcher device according to claim 1, wherein the catching mechanism is transferable from the second mode into the first mode;

the catcher device further comprising a delay device which delays a transfer of the catching mechanism from the second mode into the first mode.

7. The catcher device according to claim 6, the catcher device further comprising a first coupling element for coupling the catching mechanism to a second coupling element of a downhole tool located upstream the catching mechanism, wherein a movement of the first coupling element transfers the catching mechanism from the first mode to the second mode, wherein the first coupling element forms at least part of a swivel coupling;

the catching mechanism comprising a diverter, the diverter being movable from a first position into a second position wherein the first position corresponds to the first mode and the second position corresponds to the second mode; further wherein the movement of the first coupling element is an axial movement in a first direction and wherein a movement of the diverter from the first position to the second position includes a rotational movement crosswise the axial movement;

the catcher device further comprising a guiding mechanism which translates the axial movement into the rotational movement, wherein the guiding mechanism includes a guide pin and guide groove arrangement; and wherein the delay device includes a bias element biasing the guiding mechanism such that upon a return movement of the first coupling element in a return direction the guiding mechanism follows the movement of the first coupling element, thus delaying a return from the second position into the first position.

8. The catcher device according to claim 6, wherein the delay device is hydraulically operated, electromagnetically operated, and/or mechanically operated.

9. The catcher device according to claim 6, wherein a delay time, by which the transfer of the catching mechanism from the second mode into the first mode is delayed, is adapted to catch the second operation element and at least one third operation element before the return to the first mode, wherein the second operation element is an activating element and the at least one third operation element is a deactivating element.

10. The catcher device according to claim 1, further comprising a hollow catcher body; and a catcher cage within the hollow catcher body;

wherein the catcher cage is axially movable with respect to the hollow catcher body.

11. The catcher device according to claim 10, the catcher device further comprising a first coupling element for coupling the catching mechanism to a second coupling element of a downhole tool located upstream the catching mechanism, wherein a movement of the first coupling element transfers the catching mechanism from the first mode to the second mode, wherein the first coupling element forms at least part of a swivel coupling;

the diverter being movable from a first position into a second position wherein the first position corresponds to the first mode and the second position corresponds to the second mode; further wherein the movement of the first coupling element is an axial movement in a first direction and wherein a movement of the diverter from the first position to the second position includes a rotational movement crosswise the axial movement; and wherein the diverter and the catcher cage are rotatable with respect to each other.

12. The catcher device according to claim 10, the catcher device further comprising a first coupling element for coupling the catching mechanism to a second coupling element of a downhole tool located upstream the catching mechanism, wherein a movement of the first coupling element transfers the catching mechanism from the first mode to the second mode, wherein the first coupling element forms at least part of a swivel coupling;

the diverter being movable from a first position into a second position wherein the first position corresponds to the first mode and the second position corresponds to the second mode; further wherein the movement of the first coupling element is an axial movement in a first direction and wherein a movement of the diverter from the first position to the second position includes a rotational movement crosswise the axial movement:

the catcher device further comprising a guiding mechanism which translates the axial movement into the rotational movement, wherein the guiding mechanism includes a guide pin and guide groove arrangement;

wherein the guiding mechanism is partially provided by the catcher cage, and wherein the guiding mechanism is provided by the diverter and the catcher cage.

13. A downhole tool, the downhole tool comprising:

a hollow tool body connected to the down hole catcher device according to claim 1; and a coupling element movable within the hollow tool body and being coupleable to a coupling element of the catching mechanism of the catcher device.

14. A tool and catcher combination comprising the catcher device according to claim 2; and a downhole tool comprising the second coupling element coupled to the first coupling element of the catcher device, wherein the downhole tool is a bypass tool and the movable element is a valve sleeve movable to selectively open or close bypass ports of the bypass tool.

15. The tool and catcher combination according to claim 14, wherein rolling bearing elements are provided between the first coupling element and the second coupling element.

16. The tool and catcher combination according to claim 15, wherein the first coupling element comprises a first groove;

the second coupling element comprises a second groove, the second groove facing the first groove;

the rolling bearing elements are running in both the first groove and the second groove to thereby allow a rotation of the first coupling element with respect to the second coupling element and to limit an axial movement of the first coupling element and the second coupling element with respect to each other.

17. A method of operating a downhole catcher device according to claim 1, the method comprising:

transferring the catching mechanism between the first mode for passing by the first operation element and the second mode for catching the second operation element.

18. The method of claim 17 further comprising:

maintaining the catching mechanism in the second mode for a time period sufficient to catch the second operation element and at least one third operation element, wherein the second operation element is an activating element and the at least one third operation element is a deactivating element.

19. The method of claim 17, the method further comprising moving the diverter from a first position into a second position, wherein the first position corresponds to the first mode and the second position corresponds to the second mode.

* * * * *